United States Patent [19]

Miles

[11] Patent Number: 4,614,284

[45] Date of Patent: Sep. 30, 1986

[54] CO-DISPENSER

[75] Inventor: Gilbert Miles, Croton-on-Hudson, N.Y.

[73] Assignee: Walter Leeds, Fort Lee, N.J.

[21] Appl. No.: 623,326

[22] Filed: Jun. 22, 1984

[51] Int. Cl.[4] ..... B67D 5/40

[52] U.S. Cl. ..... 222/331; 222/541; 222/383

[58] Field of Search ..... 222/541, 578, 481, 482, 222/572, 566, 383, 321, 207, 209, 182, 331; 220/265; 239/333; D9/300

[56] References Cited

U.S. PATENT DOCUMENTS

| | | | |
|---|---|---|---|
| D. 238,655 | 2/1976 | McKinney et al. . | |
| D. 244,991 | 7/1977 | Weckman et al. . | |
| 697,700 | 4/1962 | Alden | 222/321 |
| 705,013 | 7/1902 | Baeuerk | 222/482 |
| 2,340,419 | 2/1944 | Nawoj et al. | 222/541 |
| 2,859,901 | 11/1958 | Ardito | 222/541 |
| 3,182,861 | 5/1965 | Nataf | 222/541 |
| 3,572,660 | 3/1971 | Mahon et al. | 222/541 |

*Primary Examiner*—H. Grant Skaggs
*Attorney, Agent, or Firm*—Kane, Dalsimer, Kane, Sullivan and Kurucz

[57] ABSTRACT

A container having a trigger actuated pump is provided with a sealed spout designed to provide a co-dispensing opening designed to dispense product in larger dosage amounts independently of and as a bypass of the pump. The spout extends upwardly from a pummel at the container top and through an opening in the shroud. The spout is adapted to be cut, snipped or otherwise severed to provide the co-dispensing opening.

7 Claims, 4 Drawing Figures

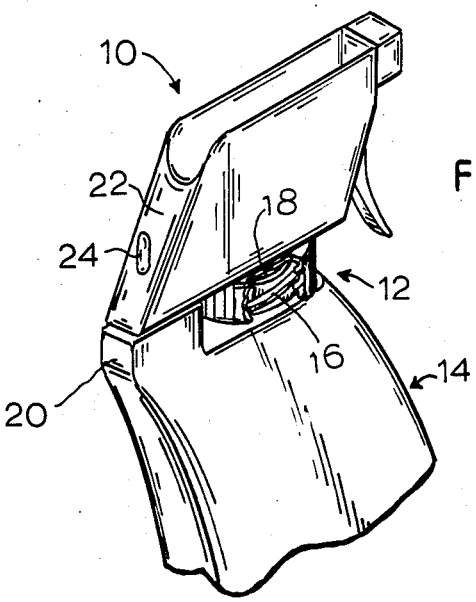
FIG.1
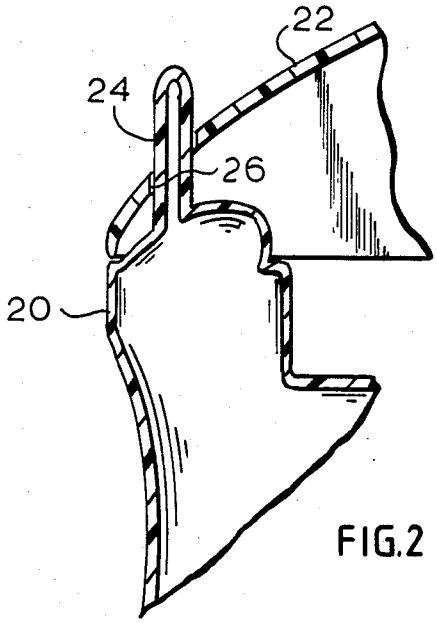
FIG.2
FIG.3
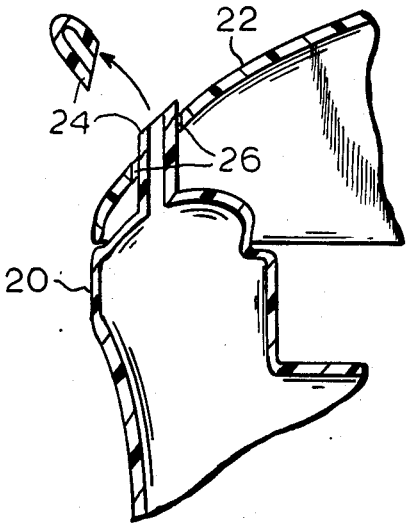
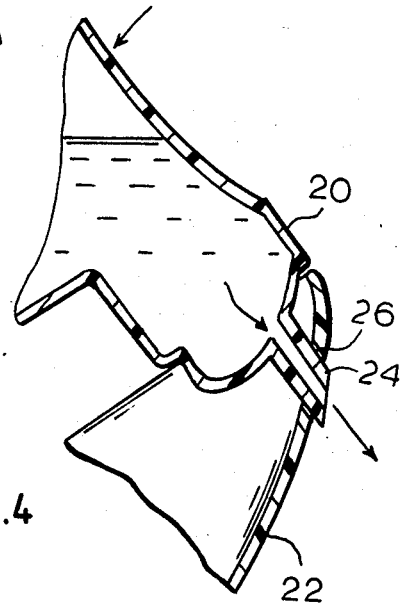
FIG.4

CO-DISPENSER

BACKGROUND OF THE INVENTION

Pump actuated dispensers particularly for household products have gained wide acceptance. Trigger actuated pumps, for example are becoming increasingly popular for dispensing detergents in selected patterns on a variety of areas and surfaces. However, the dosage dispensed by such pumps is restricted and where larger amounts are needed or desired for certain applications the pump is required to be actuated several times until this quantity is applied. This manual manipulation is time consuming, fatiguing and in some instances a nuisance and annoyance to many housewives. In order to circumvent this problem, some housewives remove the pump and pour the detergent in the desired amounts from the container neck opening. This procedure has many attendant problems, including the time necessary to remove and reapply the pump. Often times the removed pump will be misplaced or lost or placed on the container improperly, greatly reducing the effective and intended dispensing of the product.

SUMMARY OF THE INVENTION

A principal object of the present invention is to provide a container having a dispensing pump with a co-dispensing capability permitting by passing of the pump.

Another object is to provide a container and pump of the foregoing type in which a co-dispensing outlet is defined by a severable spout that may be integrally molded on a container utilizing conventional blow molding techniques without requiring major revision of existing blow molding equipment and tooling.

A further object is to provide a severable spout of the foregoing type that permits product to be dispensed at rates and quantities larger than that capable of being dispensed by a pump.

Still another object is to provide a container and dispensing pump of the foregoing type in which the pump is trigger actuated and includes a shroud and the container has a pummel that cooperates with the shroud for orienting and stabilizing the pump with the spout extending vertically through an accommodating hole in the shroud without affecting the aesthetics and consumer appeal of the pump nor requiring special assembly equipment or any substantial change to existing assembly equipment.

A still further object is to provide a container and pump of the foregoing type that provides marketers with a commercial product that may be readily, selectively and independently sprayed or poured or squeezed by a housewife or user.

Another important object is to provide a plastic blow molded container of the foregoing type with a small severable tip through which products may be dispensed by squeezing the container with small risk of spillage after the tip is cut off.

Other objects and advantages will become apparent from the following detailed description to be taken in conjunction with the accompanying drawings.

BRIEF DESCRIPTION OF THE DRAWINGS

FIG. 1 is a fragmentary perspective view of the top of a container having a trigger actuated pump and a verticle severable spout providing a co-dispensing outlet;

FIG. 2 is an enlarged fragmentary sectional view showing the relationship between an unsevered spout and pump shroud;

FIG. 3 is a similar sectional view showing the spout in the process of being severed to provide a co-dispensing outlet; and FIG. 4 is still another similar sectional view showing product being dispensed through the co-dispensing outlet.

DETAILED DESCRIPTION

In the drawings, a manually operated trigger actuated pump or sprayer 10 is shown mounted on the top 12 of a container or bottle 14. Bottle 14 may be fabricated by current blow molding techniques and equipment and will include the usual threaded neck 16 defining opening 18 and on which the trigger pump 12 is threadedly attached. In accordance with a commercially acceptable line of products the bottle 14 is also provided with an integrally molded, upwardly extending pummel 20 designed to cooperate with shroud 22 of the pump 10 in orienting and stabilizing the pump on the top of the bottle.

Pump 10 may be of any commercial variety but preferably is of the type manufactured and offered commercially by the Texize Division of Morton Thiokol, Inc., Greenville, S.C. as well as that disclosed in U.S. Pat. No. 3,749,290. This pump usually includes at its discharge end a multiple purpose nozzle that is adjustable between several positions from "Off to" "Spray" and "Stream". A nozzle of this type is disclosed in U.S. Pat. No. 2,843,030. The pump 10 may under these circumstances be employed for discharging many household products including detergents, cleaning fluids and the like on any surface and with a variety of discharge patterns.

As previously explained, many applications require discharge of the product from the bottle 10 at relatively high rates and with increased volume not normally satisfied by the incremental dosages normally attributed to a single actuation of the pump or for that matter several actuations. Therefore, the present invention provides a co-dispensing feature that permits the pump discharge network to be bypassed or supplemented. Towards this end, the pummel 20 is provided with an integrally molded, upwardly projecting spout 24 having an axis substantially parallel to the axis of neck opening 18. This spout is capable of being molded on existing blow molding equipment and tooling without any substantial modification or change. Most advantageously the spout 24 is closed or sealed until such time as the housewife wishes to use the co-dispensing feature at which time she merely severs, cuts or snips-off the spout 24 at the selected location with a knife, scissors or like instrument.

Of further importance is the ability to maintain the integrity of the shroud 22 and its aesthetically pleasing appearance as well as its functional attributes in orienting and stabilizing the pump 10 on the bottle 14 without requiring any material alteration on existing assembly equipment or necessitating new, assembly equipment. In this regard, the shroud 22 is formed with an opening 26 that conveniently receives the unsevered spout 24. If desired or necessary the spout 24 may be tapered for self centering in opening 26. The interengagement of these parts will serve to further reduce play or movement of shroud on the bottle. When it is desired to utilize the co-dispensing opening, that portion of the spout 24 extending upwardly beyond the exterior surfaces of the shroud 22 is severed, cut or snipped off by any suitable tool or instrument such as a knife or scissors. In fact, the line of severance may coincide with the line or contour of the shroud as shown.

Thus the several aforenoted objects and advantages are most effectively attained. Although several somewhat preferred embodiments have been disclosed and described in detail herein, it should be understood that this invention is in no sense limited thereby and its scope is to be determined by that of the appended claims.

I claim:

1. A co-dispenser package comprising in combination; a container comprising a body; a neck at the top of the body having an opening for introducing and removing product from the body; a sealed spout extending from the body; the spout capable of being severed to provide a co-dispensing outlet; a dispensing pump mounted on the neck for selectively dispensing the product from the container; the pump including a shroud; an opening in the shroud, and the spout extending through the opening in the shroud and that portion of the spout extending beyond the shroud is the portion of the spout capable of being severed.

2. The invention in accordance with claim 1 wherein the spout extends along an axis substantially parallel to the axis of the neck opening.

3. The invention in accordance with claim 2 wherein the spout is positioned at the top of the body.

4. The invention in accordance with claim 3 wherein the pump is a trigger pump.

5. The invention in accordance with claim 4 wherein a pummel extends upwardly from the body top and spaced from the neck and the spout extending upwardly from the pummel.

6. The invention in accordance with claim 5 wherein the shroud extends over the pummel, the opening in the shroud spaced inwardly from the edge of the shroud, and the spout extending through the shroud.

7. A co-dispenser package comprising in combination: a container comprising a body; a neck at the top of the body having an opening for introducing and removing product from the body; a sealed spout extending along an axis substantially parallel to the axis of the neck opening; a pummel extending upwardly from the body top and spaced from the neck and the spout extending upwardly from the pummel; the spout capable of being unsealed to provide a co-dispensing outlet; a dispensing pump mounted on the neck for selectively dispensing the product from the container, the pump being a trigger pump and including a shroud, an opening in the shroud, the shroud extending over the pummel, the opening in the shroud spaced inwardly from the edge of the shroud, and the spout extending through the opening in the shroud.

* * * * *